US009791179B2

(12) United States Patent
Kim

(10) Patent No.: US 9,791,179 B2
(45) Date of Patent: Oct. 17, 2017

(54) HEAT PUMP SYSTEM USING SHELL AND TUBE HEAT EXCHANGERS AND THREE-WAY VALVES

(71) Applicant: LG ELECTRONICS INC., Seoul (KR)

(72) Inventor: Jinsung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 504 days.

(21) Appl. No.: 14/220,573

(22) Filed: Mar. 20, 2014

(65) Prior Publication Data

US 2015/0159922 A1 Jun. 11, 2015

(30) Foreign Application Priority Data

Dec. 9, 2013 (KR) ..... 10-2013-0152633

(51) Int. Cl.
*F25B 13/00* (2006.01)
*F28D 7/16* (2006.01)
*F28D 21/00* (2006.01)

(52) U.S. Cl.
CPC ..... *F25B 13/00* (2013.01); *F28D 7/1607* (2013.01); *F25B 2313/02732* (2013.01); *F28D 2021/0068* (2013.01)

(58) Field of Classification Search
CPC ..... F25B 13/00; F25B 2313/02732
USPC ..... 62/324.1
See application file for complete search history.

(56) References Cited

U.S. PATENT DOCUMENTS 5,473,907 A * 12/1995 Briggs ..... F24D 5/12 62/238.7
5,875,637 A * 3/1999 Paetow ..... F25B 1/053 62/117
5,996,356 A * 12/1999 Kishimoto ..... F25B 1/00 165/140

* cited by examiner

*Primary Examiner* — David Teitelbaum
(74) *Attorney, Agent, or Firm* — Ked & Associates LLP

(57) ABSTRACT

A heat pump system is provided. The heat pump system may include a compressor that compresses a refrigerant, a condenser that condenses the refrigerant, an expansion device that decompresses the refrigerant, and an evaporator that evaporates the refrigerant. The condenser may include a first heat exchanger of a first shell and tube heat exchanger and a second shell and tube heat exchanger. The evaporator may include a second heat exchanger of the first shell and tube heat exchanger and the second shell and tube heat exchanger. The first shell and tube heat exchanger or the second shell and tube heat exchanger may include a shell, in which the refrigerant may be introduced, a plurality of tubes disposed within the shell and into which a fluid heat-exchanged with the refrigerant may flow, two inlet/outlets disposed on a first side of the shell, and one inlet/outlet disposed on a second side of the shell.

18 Claims, 8 Drawing Sheets

-RELATED ART-

HEAT PUMP SYSTEM USING SHELL AND TUBE HEAT EXCHANGERS AND THREE-WAY VALVES

CROSS-REFERENCE TO RELATED APPLICATION(S)

The present application claims priority under 35 U.S.C. 119 and 35 U.S.C. 365 to Korean Patent Application No. 10-2013-0152633, filed in Korea on Dec. 9, 2013, which is hereby incorporated by reference in its entirety.

BACKGROUND

1. Field

A heat pump system is disclosed herein.

2. Background

Heat pump systems are systems in which a refrigerant cycle operates to perform cooling and/or heating functions. The refrigerant cycle may include a compressor that compresses a refrigerant, a condenser that condenses the compressed refrigerant, an expansion device that decompresses the condensed refrigerant, and an evaporator that evaporates the decompressed refrigerant.

The condenser and the evaporator may serve as heat-exchangers to heat-exchange the refrigerant with a predetermined fluid. The predetermined fluid may include air or water.

If water is used as the predetermined fluid, the heat exchanger used for the condenser and the evaporator may include a shell and tube heat exchanger. The shell and tube heat exchanger may include a shell in which a refrigerant may flow, and a plurality of tubes disposed within the shell to allow water to flow therethrough. While the refrigerant and the water are heat-exchanged within the shell, the refrigerant may be condensed or evaporated.

In general, the shell and tube heat exchanger may be used in a chiller system. A chiller may supply cool water into a cool water consumer's place. In the chiller, a refrigerant circulating into a refrigerating system and water circulating between the cool water consumer's place and the refrigerating system may be heat-exchanged to cool the water. The chiller may be large-scaled equipment and thus installed at large buildings.

FIG. 1 is a schematic diagram of a refrigerant cycle applied to a shell and tube heat exchanger according to related art. Referring to FIG. 1, a refrigerant system 1 according to the related art may be provided with a refrigerating cycle.

In more detail, the refrigerant system 1 may include a compressor 2 that compresses a refrigerant, a condenser 3, into which a high-temperature, high-pressure refrigerant compressed in the compressor 2 may be introduced, an expansion device 8 that decompresses the refrigerant, which has been condensed in the condenser 3, and an evaporator 10 that evaporates the refrigerant, which has been decompressed in the expansion device 8. The refrigerant system 1 may further include a suction tube 15 disposed at an inlet side of the compressor 2 to guide the refrigerant discharged from the evaporator 10 into the compressor 2, and a discharge tube 16 disposed at an outlet side of the compressor 2 to guide the refrigerant discharged from the compressor 2 into the condenser 3. An oil recovery tube 9 to guide oil existing within the evaporator 10 into a suction side of the compressor 2 may be disposed between the evaporator 10 and the compressor 2.

The condenser 3 and the evaporator 10 may be provided as a shell and tube heat exchanger so that the refrigerant and the water may be heat-exchanged with each other. In more detail, the condenser 3 may include a shell 3*a* that defines an outer appearance thereof, a refrigerant inflow 4 disposed on a first side of the shell 3*a* and through which the refrigerant compressed in the compressor 2 may be introduced, and a refrigerant discharge 5 disposed on a second side of the shell 3*a* and through which the refrigerant condensed in the condenser 3 may be discharged.

The refrigerant inflow 4 may be disposed on an upper portion of the shell 3*a*, and the refrigerant discharge 5 may be disposed on a lower portion of the shell 3*a*. Thus, when a high-temperature, high-pressure refrigerant gas is introduced into the refrigerant inflow 4, the refrigerant gas may be changed in phase into a liquid refrigerant having a high specific gravity while being heat-exchanged, and the liquid refrigerant may be easily discharged through the refrigerant discharge 5.

The condenser 3 may further include an inner passage 3*b* disposed within the shell 3*a* to guide a flow of the refrigerant. The inner passage 3*b* may include a plurality of tubes. The fluid may include water, for example.

The condenser 3 may include a condenser inflow passage 6 to introduce the fluid into the shell 3*a*, and a condenser discharge passage 7 to discharge the fluid, which has been heat-exchanged in the condenser 3 on a side thereof. The fluid introduced into the shell 3*a* through the condenser inflow passage 6 may be heat-exchanged with the refrigerant, that is, absorb heat while flowing into the inner passage 3*b* and then be discharged through the condenser discharge passage 7. With this process, the refrigerant may be condensed.

The evaporator 10 may include a shell 10*a* that defines an outer appearance thereof, a refrigerant inflow 11 disposed on a first side of the shell 10*a* and through which the refrigerant expanded in the expansion device 8 may be introduced, and a refrigerant discharge 12 disposed on a second side of the shell 10*a* and through which the refrigerant evaporated in the evaporator 10 may be discharged. The refrigerant discharge 12 may be connected to the suction tube 15.

The refrigerant inflow 11 may be disposed on a lower portion of the shell 10*a*, and the refrigerant discharge 12 may be disposed on an upper portion of the shell 10*a*. Thus, when a low-temperature, low-pressure, two-phase refrigerant is introduced into the refrigerant inflow 11, the two-phase refrigerant may be changed in phase into a gas refrigerant having a low specific gravity while being heat-exchanged, and then the gas refrigerant may flow upward and be easily discharged through the refrigerant discharge 12.

The evaporator 10 may further include an inner passage 10*b* disposed within the shell 10*a* to guide a flow of the fluid. The inner passage 10*b* may include a plurality of tubes. The fluid may include water, for example.

The evaporator 10 may include an evaporator inflow passage 13 to introduce the fluid into the shell 10*a*, and an evaporator discharge passage 14 to discharge the fluid, which has been heat-exchanged in the evaporator 10, on a side thereof. The fluid introduced into the shell 10*a* through the evaporator inflow passage 13 may be heat-exchanged with the refrigerant, that is, dissipate heat while flowing into the inner passage 10*b* and then be discharged through the evaporator discharging passage 14. With this process, the refrigerant may be evaporated.

As described above, when the shell and tube heat exchanger according to the related art is used as the condenser, the refrigerant inflow may be disposed on the upper portion of the shell, and the refrigerant discharge may be disposed on the lower portion of the shell. Also, when the shell and tube heat exchanger according to the related art is used as the evaporator, the refrigerant inflow disposed on the lower portion of the shell, and the refrigerant discharge may be disposed on the upper portion of the shell. As a result, there is a limitation in that it is difficult to switch one heat exchanger into the condenser and the evaporator.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. Embodiments may, however, be embodied in many different forms and should not be construed as being limited to the embodiments set forth herein; rather, that alternate embodiments included in other retrogressive embodiment or falling within the spirit and scope will fully convey the concept to those skilled in the art.

Figure 1:
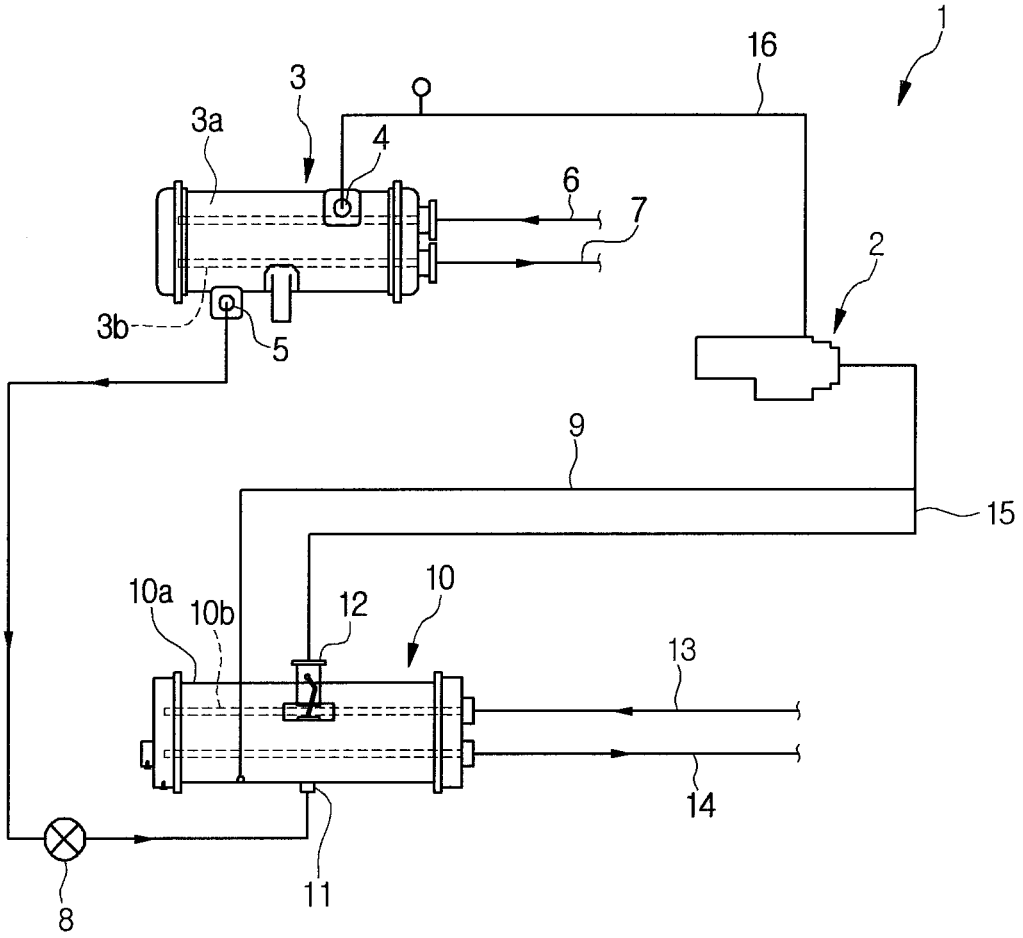
FIG. 1 is a schematic diagram of a refrigerant cycle applied to a shell and tube heat exchanger according to related art.
Figure 2:
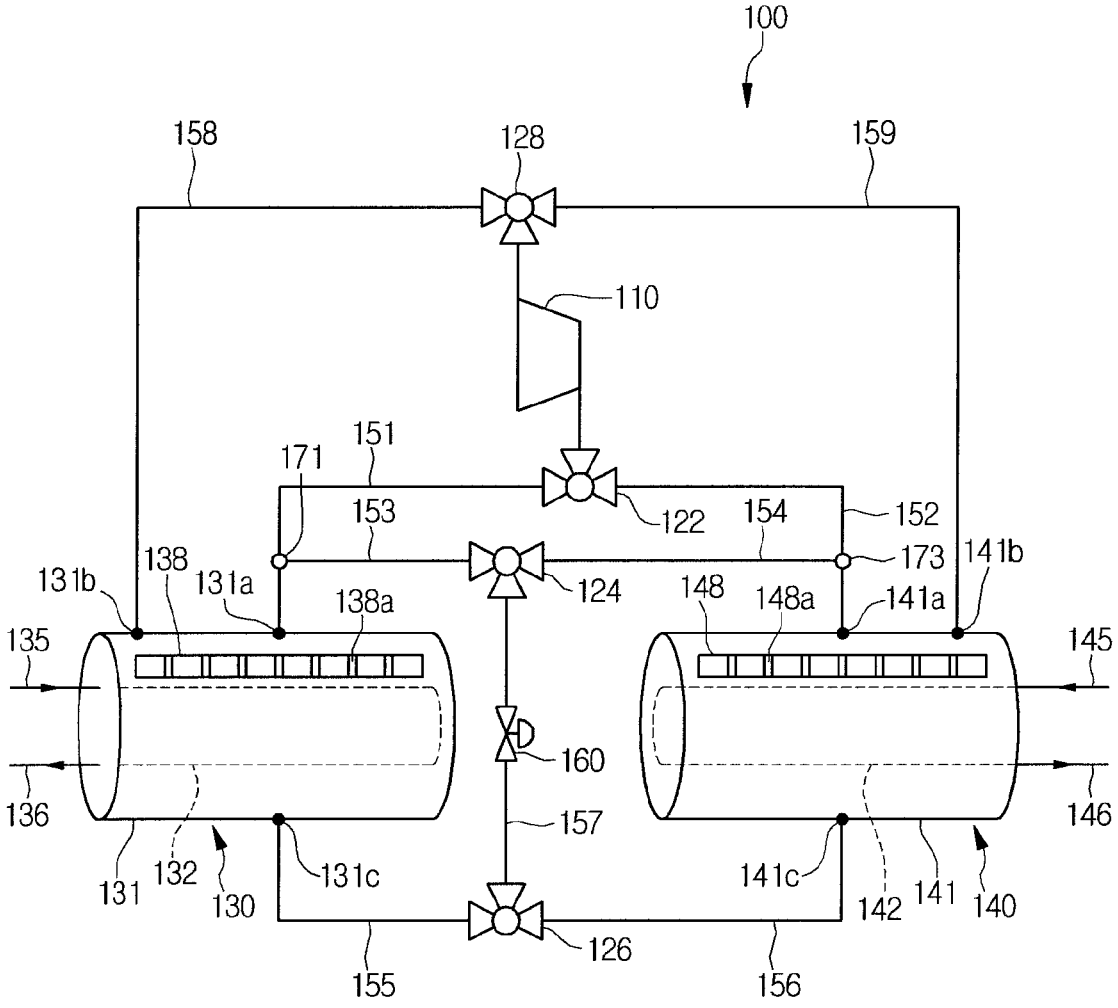
FIG. 2 is a schematic cycle diagram of a heat pump system according to an embodiment.
Figure 3:
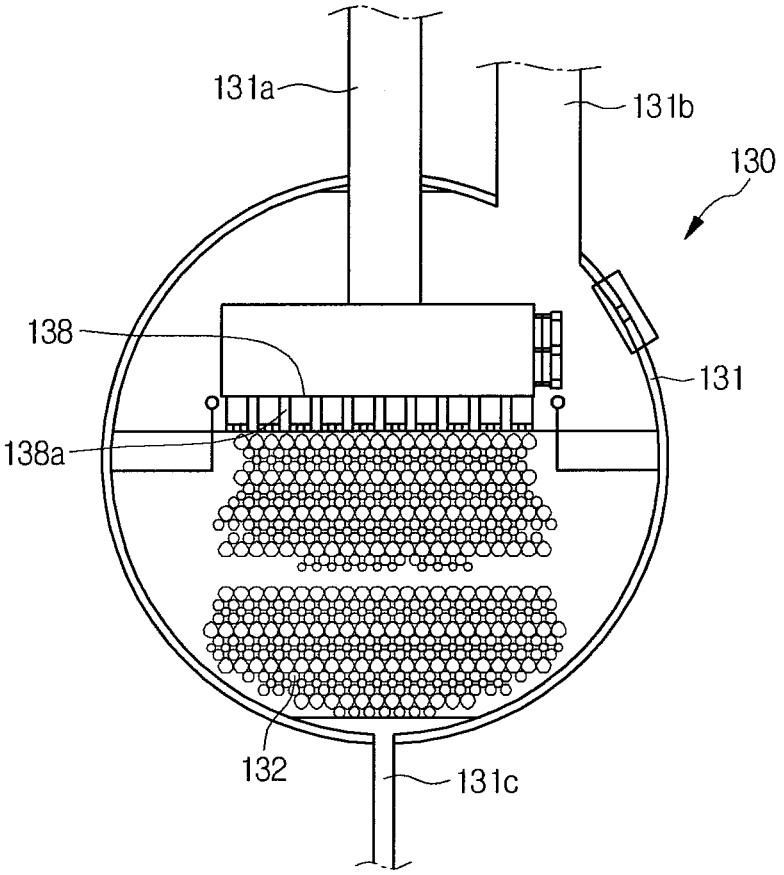
FIG. 3 is a schematic diagram of the heat exchanger of a heat pump system of FIG. 2.

FIG. 2 is a schematic cycle diagram of a heat pump system according to an embodiment. FIG. 3 is a schematic diagram of a heat exchanger of the heat pump system of FIG. 2.

Referring to FIGS. 2 and 3, a heat pump system 100 according to this embodiment may include a compressor 110 that compress a refrigerant, a condenser that condenses the high-temperature, high-pressure refrigerant compressed in the compressor 110, an expansion device 160 that decompresses the refrigerant condensed in the condenser, and an evaporator that evaporates the refrigerant decompressed in the expansion device 160.

The condenser may be at least one heat exchanger of a first heat exchanger 130 or a second heat exchanger 140, and the evaporator may be the other heat exchanger. The first heat exchanger 130 may be understood or referred to as a user-side or load-side heat exchanger, and the second heat exchanger 140 may be understood or referred to as a heat source-side heat exchanger.

Also, each of the first and second heat exchangers 130 and 140 may include a shell and tube heat exchanger. Thus, the first heat exchanger 130 may be referred to as a "first shell and tube heat exchanger", and the second heat exchanger 140 may be referred to as a "second shell and tube heat exchanger". The first and second heat exchangers 130 and 140 may have the same components.

The expansion device 160 may include an electronic expansion valve (EEV).

The heat pump system 100 may further include a plurality of flow switching devices 122, 124, 126, and 128 to switch a flow direction of the refrigerant according to the cooling or heating operation of the system. The plurality of flow switching devices 122, 124, 126, and 128 may include a first flow switching device 122 disposed on or at an outlet side of the compressor 110, a second flow switching device 124 that guides the refrigerant decompressed in the expansion device 160 to the evaporator, a third flow switching device 126 that guides the refrigerant heat-exchanged in the condenser to the expansion device 160, and a fourth flow switching device 128 that guides the refrigerant heat-exchanged in the evaporator to the compressor 110. For example, each of the plurality of flow switching devices 122, 124, 126, and 128 may include a three-way valve.

The heat pump system 100 may further include a first connection tube 151 that extends from the first flow switching device 122 to the first heat exchanger 130, and a second connection tube 152 that extends from the first flow switching device 122 to the second heat exchanger 140. The first connection tube 151 or the second connection tube 152 may be configured to guide the refrigerant compressed in the compressor 110 to the condenser. For example, if the first heat exchanger 130 serves as the condenser, the refrigerant may be introduced from the first flow switching device 122 to the first heat exchanger 130 via the first connection tube 151. On the other hand, if the second heat exchanger 140 serves as the condenser, the refrigerant may be introduced from the first flow switching device 122 to the second heat exchanger 140 via the second connection tube 152.

The heat pump system 100 may further include a third connection tube 153 that extends from a point of or on the first connection tube 151 to the second flow switching device 124, and a fourth connection tube 154 that extends from a point of or on the second connection tube 152 to the second flow switching device 124.

A first connection 171, to which the third connection tube 153 may be connected, may be disposed on or at a point of or on the first connection tube 151. Thus, the third connection tube 153 may have a first end coupled to the first connection 171 and a second end coupled to the second flow switching device 124.

A second connection 173 to which the fourth connection tube 154 may be connected, may be disposed on or at a point of or on the second connection tube 152. Thus, the fourth connection tube 154 may have a first end coupled to the second connection 173 and a second end coupled to the second flow switching device 124.

The third connection tube 153 or the fourth connection tube 154 may be configured to guide the refrigerant decompressed in the expansion device 160 to the evaporator. For example, when the first heat exchanger 130 severs as the evaporator, the refrigerant decompressed in the expansion device 160 may be introduced into the third connection tube 153 via the second flow switching device 124, and then, may be introduced into the first heat exchanger 130 via the first connection 171 and the first connection tube 151.

On the other hand, when the second heat exchanger 140 serves as the evaporator, the refrigerant decompressed in the expansion device 160 may be introduced into the fourth connection tube 154 via the second flow switching device 124, and then, may be introduced into the second heat exchanger 140 via the second connection 173 and the second connection tube 152.

The heat pump system 100 may further include a fifth connection tube 155 that extends from the first heat exchanger 130 to the third flow switching device 126, and a sixth connection tube 156 that extends from the second heat exchanger 140 to the third switching device 126. The fifth connection tube 155 or the sixth connection tube 156 may be configured to guide the refrigerant compressed in the compressor to the third flow switching device 126.

For example, when the first heat exchanger 130 serves as the condenser, the refrigerant condensed in the first heat exchanger 130 may be introduced into the third flow switching device 126 via the fifth connection tube 155. On the other hand, when the second heat exchanger 140 serves as the condenser, the refrigerant condensed in the second heat exchanger 140 may be introduced into the third flow switching device 126 via the sixth connection tube 156.

The heat pump system 100 may further include a seventh connection tube 157 that extends from the second flow switching device 124 to the third flow switching device 126. The expansion device 160 may be disposed on the seventh connection tube 157.

The refrigerant introduced into the third flow switching device 126, that is, the condensed refrigerant may be introduced into the second flow switching device 124 through the seventh connection tube 157. With this process, the refrigerant may be decompressed while passing through the expansion device 160.

The heat pump system 100 may further include an eighth connection tube 158 that extends from the first heat exchanger 130 to the fourth flow switching device 128, and a ninth connection tube 159 that extends from the second heat exchanger 140 to the fourth flow switching device 128. The eighth connection tube 158 or the ninth connection tube 159 may be configured to guide the refrigerant evaporated in the evaporator to the fourth flow switching device 128.

For example, when the first heat exchanger 130 serves as the evaporator, the refrigerant evaporated in the first heat exchanger 130 may be introduced into the fourth flow switching device 128 via the eighth connection tube 158. On the other hand, when the second heat exchanger 140 serves as the evaporator, the refrigerant evaporated in the second heat exchanger 140 may be introduced into the fourth flow switching device 128 via the ninth connection tube 159.

Hereinafter, embodiments of the first and second heat exchangers 130 and 140 will be described hereinbelow. Although only the first heat exchanger 130 is illustrated in FIG. 3, as the second heat exchanger 140 may include components similar to that of the first heat exchanger 130, features described with reference to FIG. 3 may also be applicable to the second heat exchanger 140.

The first heat exchanger 130 may be a load-side heat exchanger. When the cooling operation is performed, the first heat exchanger 130 may serve as the evaporator. On the other hand, when the heating operation is performed, the first heat exchanger 130 may serve as the condenser.

The first heat exchanger 130 may include a shell 131, which may have an approximately cylindrical shape, to provide a flow space in which the refrigerant and fluid may be introduced, and an inner passage 132 disposed within the shell 131 to guide a flow of the fluid. The inner passage 132 may include a plurality of tubes. The fluid may include water, for example.

A first inflow passage 135 to introduce the fluid into the shell 131, and a first discharge passage 136 to discharge the fluid heat-exchanged in the first heat exchanger 130 may be disposed on a first side of the first heat exchanger 130. The fluid introduced into the shell 131 through the first inflow passage 135 may be heat-exchanged with the refrigerant while flowing in the inner passage 132, and then, may be discharged through the first discharge passage 136.

When the first heat exchanger 130 serves as the condenser, the fluid passing through the first heat exchanger 130 may be heated, and thus, used as a heat source for the heating operation. On the other hand, when the first heat exchanger 130 serves as the evaporator, the fluid passing through the first heat exchanger 130 may be cooled, and thus, used as a heating source for the cooling operation.

The shell 131 of the first heat exchanger 130 may include a plurality of inlet/outlets 131*a*, 131*b*, and 131*c* through which the refrigerant may be introduced or discharged. The plurality of inlet/outlets 131*a*, 131*b*, and 131*c* may include first and second inlet/outlets 131*a* and 131*b*, which may be disposed at or on an upper portion of the shell 131, and a third inlet/outlet 131*c* disposed at or on a lower portion of the shell 131. The first and second inlet/outlets 131*a* and 131*b* may be spaced apart from each other.

The first connection tube 151 may be coupled to the first inlet/outlet 131*a*. The first inlet/outlet 131*a* may be referred to as a "refrigerant inflow" to introduce the refrigerant into the first heat exchanger 130 when the heat pump system 100 performs the cooling and heating operations.

The eighth connection tube 158 may be coupled to the second inlet/outlet 131*b*. The second inlet/outlet 131*b* may be referred to as a "first refrigerant discharge" to discharge the refrigerant evaporated in the first heat exchanger 130 when the heat pump system 100 performs the cooling operation.

The fifth connection tube 155 may be coupled to the third inlet/outlet 131*c*. The third inlet/outlet 131*c* may be referred to a "second refrigerant discharge" to discharge the refrigerant condensed in the first heat exchanger 130 when the heat pump system 100 performs the heating operation.

That is, the first heat exchanger 130 may include one refrigerant inflow and two refrigerant discharges.

A distribution device 138 to uniformly distribute the refrigerant introduced into the first heat exchanger 130 in the shell 131 may be disposed within the shell 131 of the first heat exchanger 130. The distribution device 138 may have a flat plate shape. The distribution device 138 may have a plurality of through holes 138*a*, through which refrigerant may pass. The distribution device 138 may be disposed in an upper portion of an inside of the shell 131 of the first heat exchanger 130.

The second heat exchanger 140 may be a heat source-side heat exchanger. When the cooling operation is performed, the second heat exchanger 140 may serve as the condenser. On the other hand, when the heating operation is performed, the second heat exchanger 140 may serve as the evaporator.

The second heat exchanger 140 may include a shell 141, which may have an approximately cylindrical shape, to provide a flow space in which the refrigerant and fluid may be introduced, and an inner passage 142 disposed within the shell 142 to guide a flow of the fluid. The inner passage 142 may include a plurality of tubes. The fluid may include water, for example.

A second inflow passage 145 to introduce the fluid into the shell 144, and a second discharge passage 146 to discharge the fluid heat-exchanged in the second heat exchanger 140 may be disposed on a first side of the first heat exchanger 140. The fluid introduced into the shell 141 through the second inflow passage 145 may be heat-exchanged with the refrigerant while flowing in the inner passage 142, and then, may be discharged through the second discharge passage 146.

The shell 141 of the second heat exchanger 130 may include a plurality of inlet/outputs 141*a*, 141*b*, and 141*c*, through which the refrigerant may be introduced or discharged. The plurality of inlet/outputs 141*a*, 141*b*, and 141*c* may include first and second inlet/outlets 141*a* and 141*b*, which may be disposed at or on an upper portion of the shell 141, and a third inlet/outlet 141*c* disposed at or on a lower portion of the shell 141. The first and second inlet/outlets 141*a* and 141*b* may be spaced apart from each other.

The second connection tube 152 may be coupled to the first inlet/outlet 141*a*. The first inlet/outlet part 141*a* may be referred to as a "refrigerant inflow" to introduce the refrigerant into the second heat exchanger 140 when the heat pump system 100 performs the cooling and heating operations.

The ninth connection tube 159 may be coupled to the second inlet/outlet 141*b*. The second inlet/outlet part 141*b* may be referred to as a "first refrigerant discharge" to discharge the refrigerant evaporated in the second heat exchanger 140 when the heat pump system 100 performs the heating operation.

The sixth connection tube 156 may be coupled to the third inlet/outlet 141*c*. The third inlet/outlet 141*c* may be referred to as a "second refrigerant discharge" to discharge the refrigerant condensed in the second heat exchanger 141 when the heat pump system 100 performs the cooling operation.

That is, the second heat exchanger 140 may include one refrigerant inflow and two refrigerant discharges.

A distribution device 148 to uniformly distribute the refrigerant introduced into the second heat exchanger 140 in the shell 141 may be disposed within the shell 141 of the second heat exchanger 140. The distribution device 148 may have a flat plate shape. The distribution device 148 may have a plurality of through holes 148*a*, through which the refrigerant may pass. The distribution device 148 may be disposed in an upper portion of an inside of the shell 141 of the first heat exchanger 140.

Hereinafter, a flow of refrigerant according to this embodiment will be described.

Figure 4:
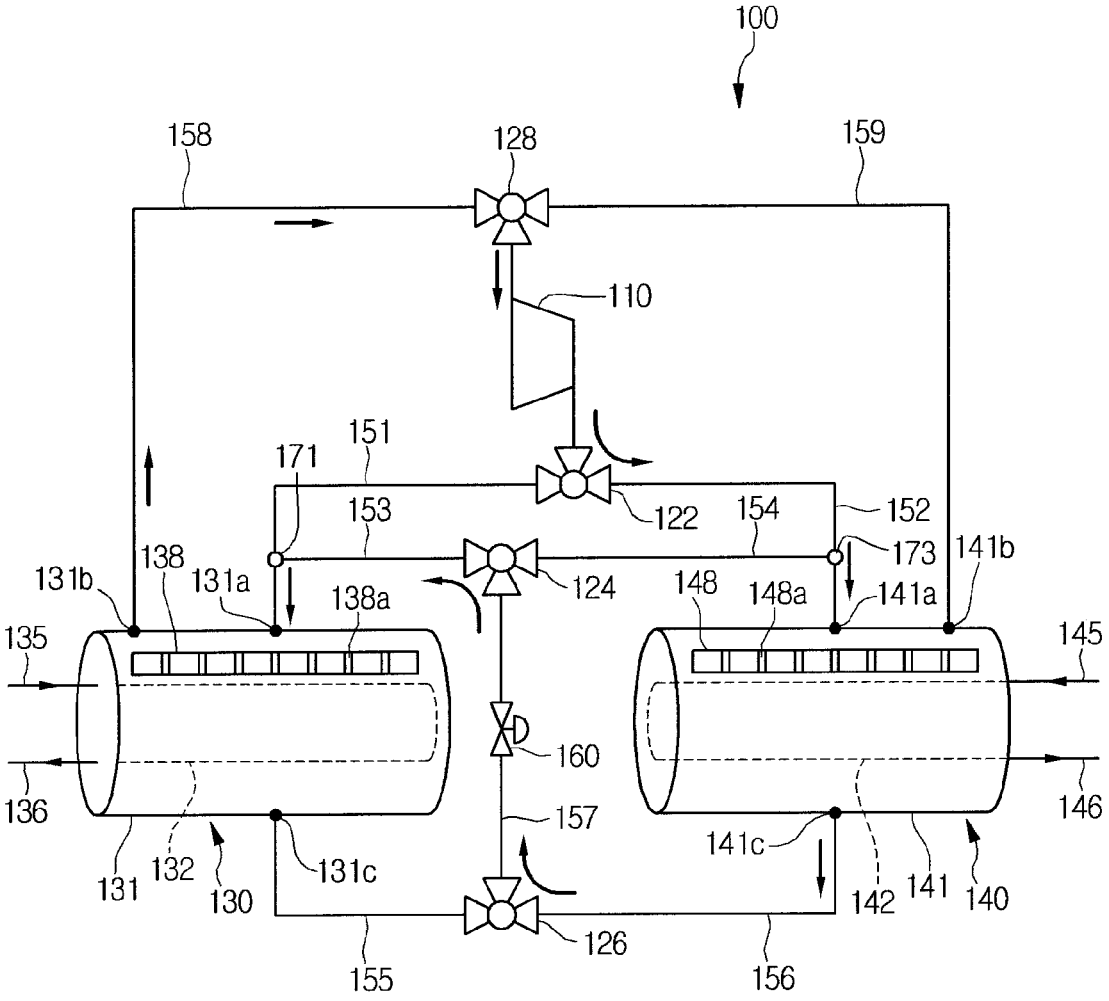
FIG. 4 is a schematic cycle diagram illustrating the heat pump system of FIG. 2 performing a cooling operation.

FIG. 4 is a schematic cycle diagram illustrating the heat pump system of FIG. 2 performing a cooling operation. Referring to FIG. 4, when the heat pump system 100 according to this embodiment performs the cooling operation, the refrigerant compressed in the compressor 110 may be introduced into the second connection tube 152 via the first flow switching device 122. The refrigerant within the second connection tube 152 may be introduced into the second heat exchanger 140 through the first inlet/outlet 141*a*. The second heat exchanger 140 may be a heat source-side heat exchanger and may serve as the condenser.

The refrigerant condensed in the second heat exchanger 140 may be discharged into the sixth connection tube 156 through the third inlet/outlet 141*c*, and then, may be introduced into the third flow switching device 126. The third flow switching device 126 may guide the refrigerant into the seventh connection tube 157. The refrigerant within the seventh connection tube 157 may be decompressed while passing through the expansion device 160.

The refrigerant decompressed in the expansion device 160 may flow into the third connection tube 153 via the second flow switching device 124, and then, may be introduced into the first connection tube 151 through the first connection 171. The refrigerant within the first connection tube 151 may be introduced into the first heat exchanger 130 through the first inlet/outlet 131*a*. The first heat exchanger 130 may be a load-side heat exchanger and may serve as the evaporator.

The refrigerant evaporated in the first heat exchanger 130 may be discharged into the eighth connection tube 158 through the second inlet/outlet 131*b*, and then, may be introduced into the fourth flow switching device 128. The fourth flow switching device 128 may guide the refrigerant into the compressor 110. This refrigerant cycle may be repeatedly performed.

Figure 5:
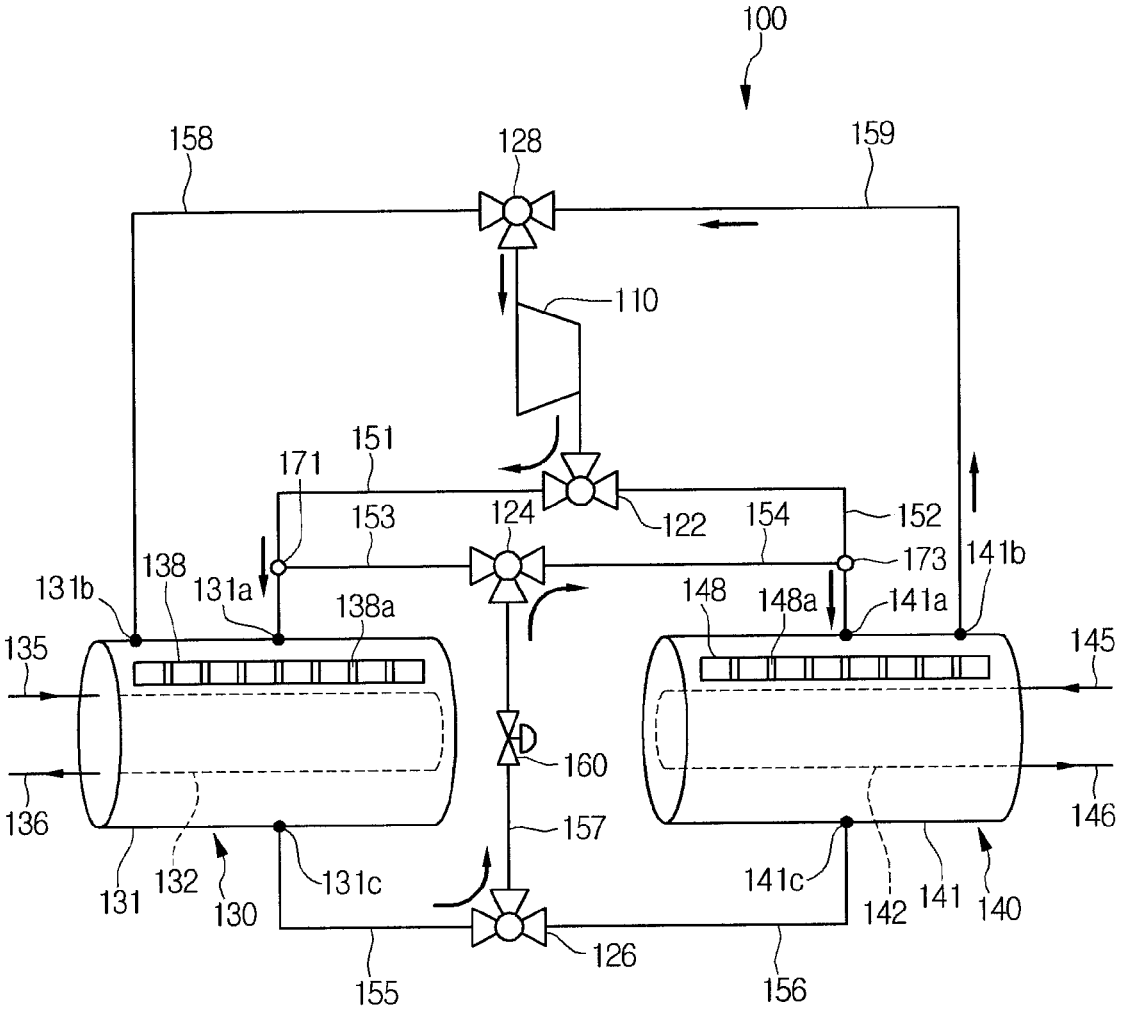
FIG. 5 is a schematic cycle diagram illustrating the heat pump system of FIG. 2 performing a heating operation.

FIG. 5 is a schematic cycle diagram illustrating the heat pump system of FIG. 2 performing a heating operation. Referring to FIG. 5, when the heat pump system 100 according to this embodiment performs the heating operation, the refrigerant compressed in the compressor 110 may be introduced into the first connection tube 151 via the first flow switching device 122. The refrigerant within the first connection tube 151 may be introduced into the first heat exchanger 130 through the first inlet/outlet 131*a*. The first heat exchanger 130 may be a load-side heat exchanger and may serve as the condenser.

The refrigerant condensed in the first heat exchanger 130 may be discharged into the fifth connection tube 155 through the third inlet/outlet 131*c*, and then, may be introduced into the third flow switching device 126. The third flow switching device 126 may guide the refrigerant into the seventh connection tube 157. The refrigerant within the seventh connection tube 157 may be decompressed while passing through the expansion device 160.

The refrigerant decompressed in the expansion device 160 may flow into the fourth connection tube 154 via the second flow switching device 124, and then, may be introduced into the second connection tube 152 through the second connection 173. The refrigerant within the second connection tube 152 may be introduced into the second heat exchanger 140 through the first inlet/outlet 141*a*. The second heat exchanger 140 may be a heat source-side heat exchanger and may serve as the evaporator.

The refrigerant evaporated in the second heat exchanger 140 may be discharged into the ninth connection tube 159 through the second inlet/outlet 141*b*, and then, may be introduced into the fourth flow switching device 128. The fourth flow switching device 128 may guide the refrigerant into the compressor 110. This refrigerant cycle may be repeatedly performed.

According to embodiments and effects of the heat pump system 100, the shell and tube heat exchanger may be easily switched into the condenser or the evaporator according to the cooling or heating operation.

Hereinafter, a description will be made according to another embodiment. As this embodiment is similar to the previous embodiment except for some components of the tube, different points between the embodiments will be principally described, and also descriptions of the same or similar parts will be denoted by the same reference numerals and repetitive description omitted.

Figure 6:
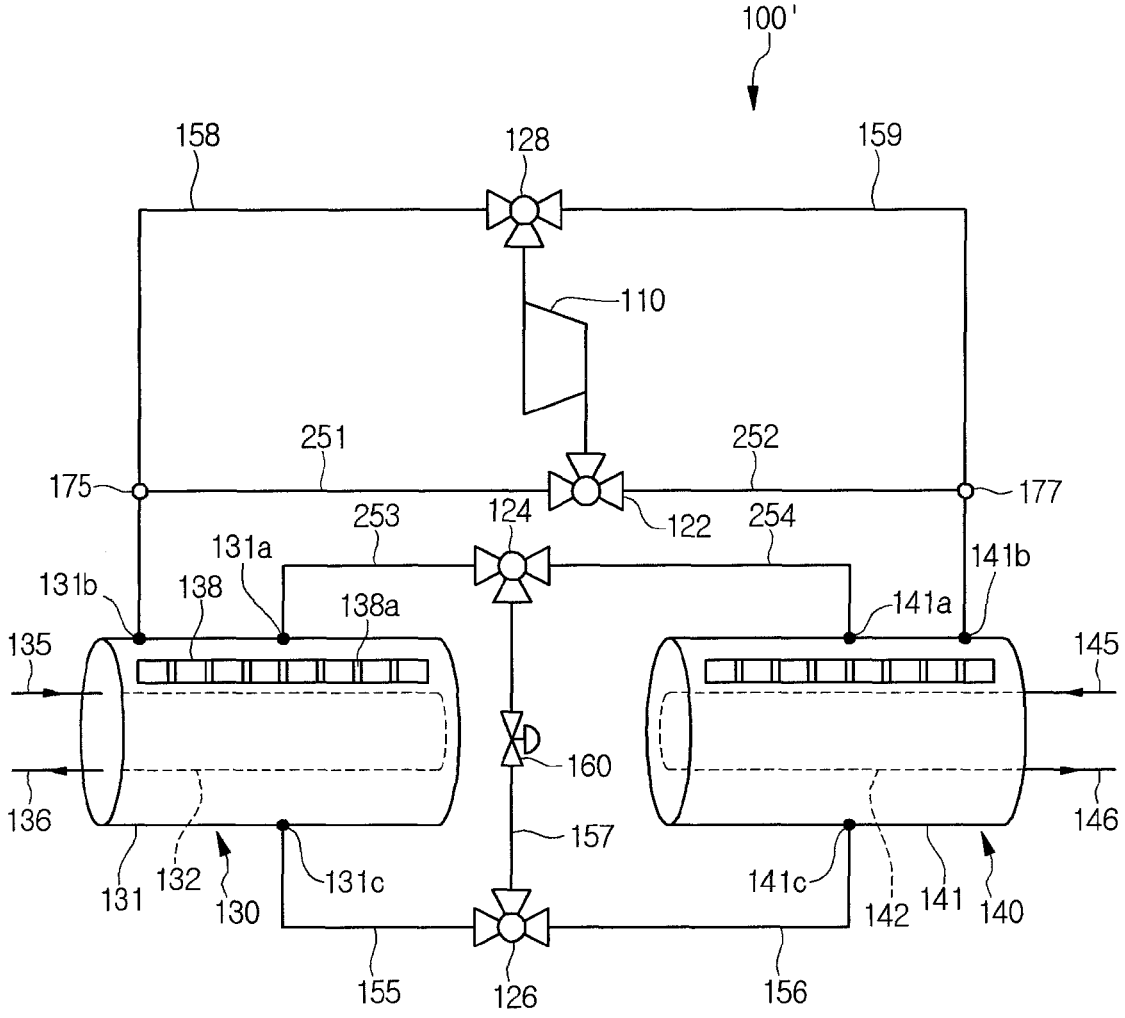
FIG. 6 is a schematic cycle diagram of a heat pump system according to another embodiment.

FIG. 6 is a schematic cycle diagram of a heat pump system according to another embodiment. Referring to FIG. 6, a heat pump system 100', according to this embodiment may include compressor 110, first heat exchanger 130, second heat exchanger 140, flow switching devices 122, 124, 126, and 128, expansion device 160, fifth connection tube 155, sixth connection tube 156, seventh connection tube 157, eighth connection tube 158, and ninth connection tube 159, which are described with respect to the first embodiment.

This embodiment is different from heat pump system 100 according to the first embodiment in that the heat pump system 100', may include a first connection tube 251 that extends from the first flow switching device 122 to a point of or on the sixth connection tube 158, and a second connection tube 252 that extends from the second flow switching device 122 to a point of or on the ninth connection tube 159. A third connection 175 connected to the first connection tube 251 may be disposed on a point of or on the eighth connection tube 158. A fourth connection 177 connected to the second connection tube 252 may be disposed on a point of or on the ninth connection tube 159.

The heat pump system 100', according to this embodiment may further include a third connection tube 253 that extends from the second flow switching device 124 to the first inlet/outlet 131*a* of the first heat exchanger 130, and a fourth connection tube 254 that extends from the second flow switching device 124 to the first inlet/outlet 141*a* of the second heat exchanger 140. The third connection tube 253 may be coupled to the first inlet/outlet 131*a*. When the heat pump system 100' performs a cooling operation, the first inlet/outlet part 131*a* may be referred to as a "refrigerant inflow" to introduce the refrigerant into the first heat exchanger 130. The eighth connection tube 158 may be coupled to the second inlet/outlet 131*b*. The second inlet/outlet part 131*b* may be referred to as a "switchable inlet/outlet" to discharge the refrigerant evaporated in the first heat exchanger 130 when the heat pump system 100' performs the cooling operation and to introduce the refrigerant into the first heat exchanger 130 when the heat pump system 100' performs the heating operation.

The fifth connection tube 155 may be coupled to the third inlet/outlet 131*c*. The third inlet/outlet part 131*c* may be referred to as a "refrigerant discharge" to discharge the refrigerant condensed in the first heat exchanger 130 when the heat pump system 100' performs the heating operation. That is, the first heat exchanger 130 may include one refrigerant inflow, one refrigerant discharge, and one switchable inlet/outlet.

The fourth connection tube 254 may be coupled to the first inlet/outlet 141*a*. The first inlet/outlet 141*a* may be referred to as a "refrigerant inflow" to introduce the refrigerant into the second heat exchanger 140 when the heat pump system 100' performs the heating operation.

The ninth connection tube 159 may be coupled to the second inlet/outlet 141*b*. The second inlet/outlet part 141*b* may be referred to as a "switchable inlet/outlet" to introduce the refrigerant when the heat pump system 100' performs the cooling operation and to discharge the refrigerant evaporated in the second heat exchanger 140 when the heat pump system 100' performs the heating operation.

The sixth connection tube 156 may be coupled to the third inlet/outlet 141*c*. The third inlet/outlet 141*c* may be referred to as a "refrigerant discharge" to discharge the refrigerant condensed in the first heat exchanger 141 when the heat pump system 100' performs the heating operation.

That is, the second heat exchanger 140 may include one refrigerant inflow, one refrigerant discharge, and one switchable inlet/outlet.

Figure 7:
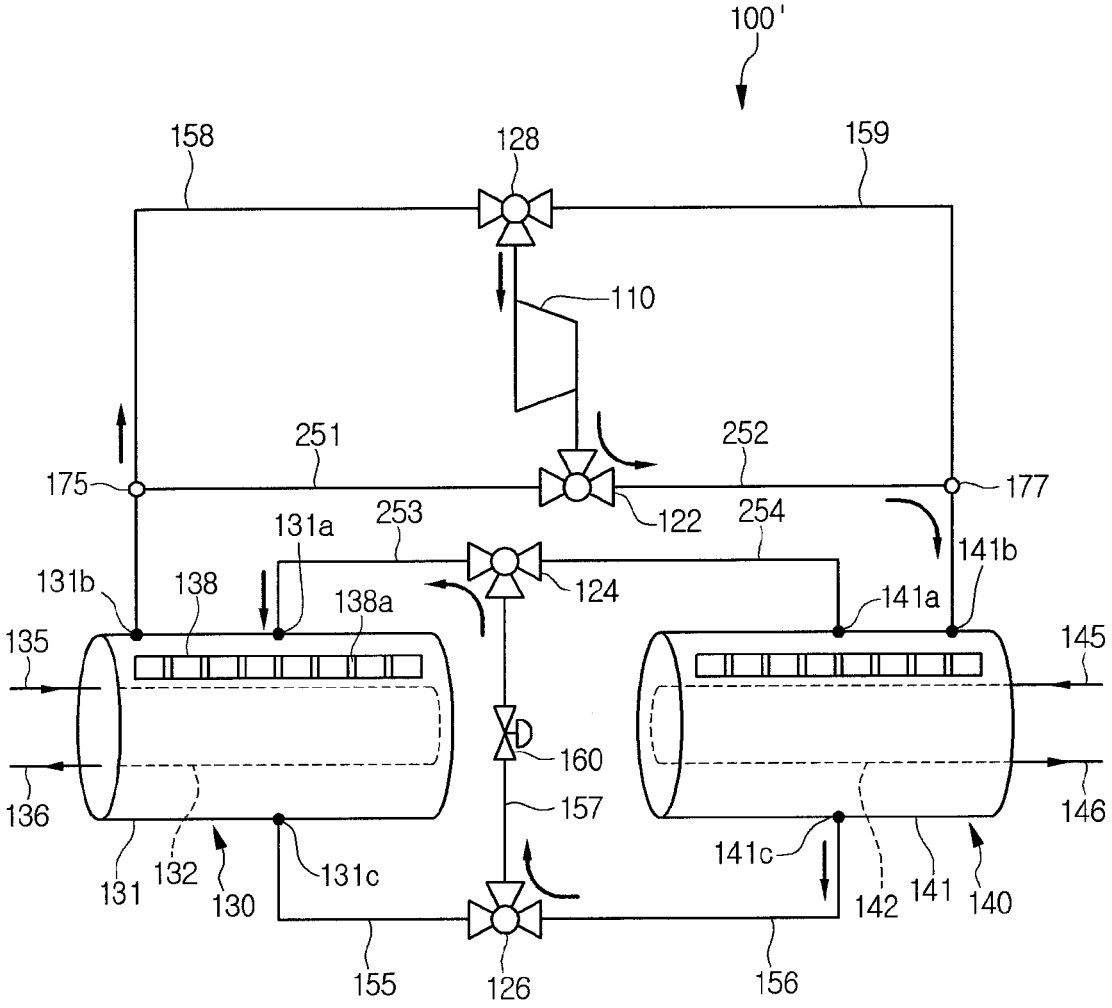
FIG. 7 is a schematic cycle diagram illustrating the heat pump system of FIG. 6 performing a cooling operation.

FIG. 7 is a schematic cycle diagram of the heat pump system of FIG. 6 performing a cooling operation. Referring to FIG. 7, when the heat pump system 100', according to this embodiment performs the cooling operation, the refrigerant compressed in the compressor 110 may be guided into the second connection tube 152 via the first flow switching device 122.

The refrigerant within the second connection tube 152 may be introduced into the ninth connection tube 159 through the fourth connection 177, and then, may be introduced into the second heat exchanger 140 through the second inlet/outlet 141*b*. The second heat exchanger 140 may be a heat source-side heat exchanger and may serve as the condenser.

The refrigerant condensed in the second heat exchanger 140 may be discharged into the sixth connection tube 156 through the third inlet/outlet 141*c*, and then, may be introduced into the third flow switching device 126. The third flow switching device 126 may guide the refrigerant into the seventh connection tube 157. The refrigerant within the seventh connection tube 157 may be decompressed while passing through the expansion device 160.

The refrigerant decompressed in the expansion device 160 may flow into the third connection tube 253 via the second flow switching device 124, and then, may be introduced into the first heat exchanger 130 through the first inlet/outlet 131*a*. The first heat exchanger 130 may be a load-side heat exchanger and may serve as the evaporator.

The refrigerant evaporated in the first heat exchanger 130 may be discharged into the eighth connection tube 158 through the second inlet/outlet 131*b*, and then, may be introduced into the fourth flow switching device 128. The fourth flow switching device 128 may guide the refrigerant into the compressor 110. This refrigerant cycle may be repeatedly performed.

Figure 8:
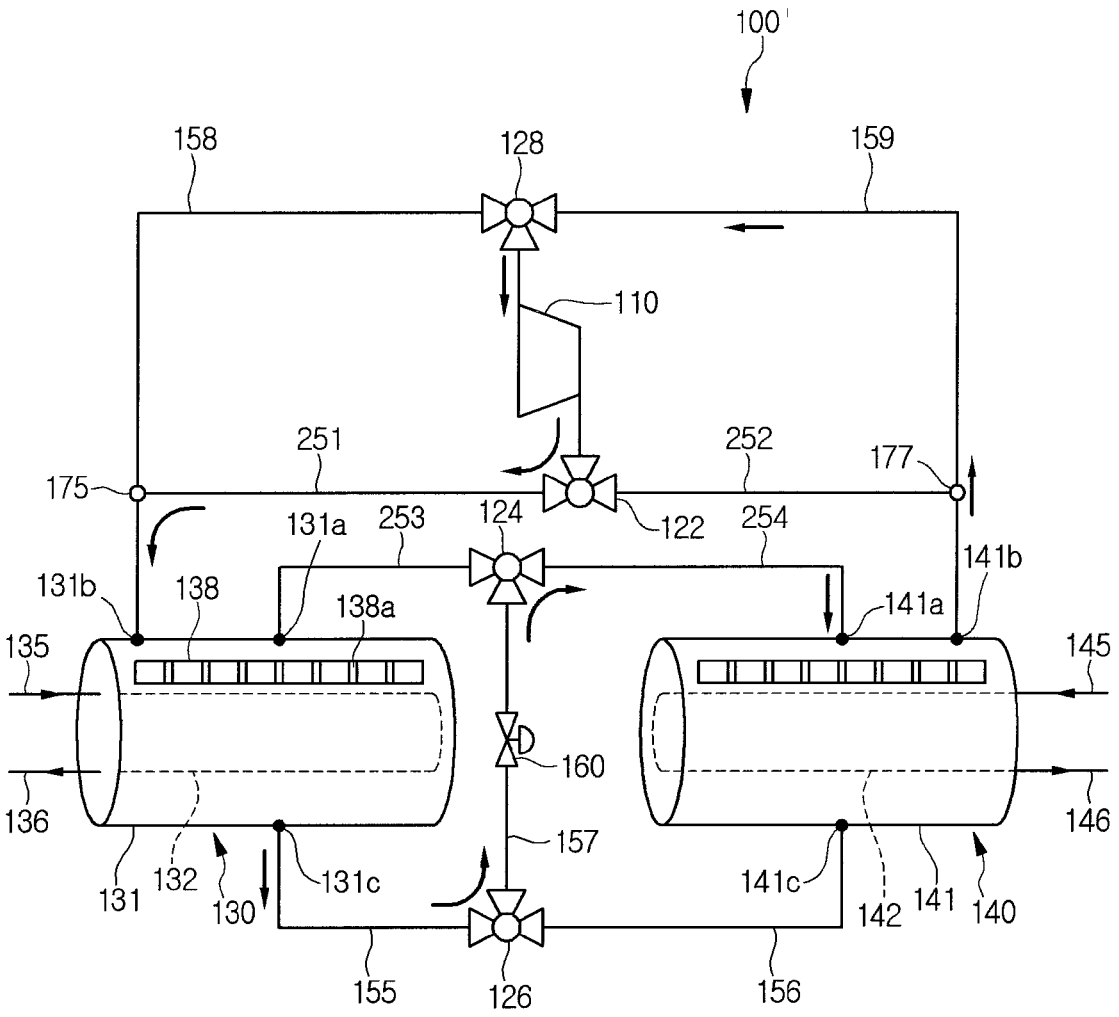
FIG. 8 is a schematic cycle diagram illustrating the heat pump system of FIG. 6 performing a heating operation.

FIG. 8 is a schematic cycle diagram of the heat pump system of FIG. 6 performing a heating operation. Referring to FIG. 8, when the heat pump system 100', according to this embodiment performs the heating operation, the refrigerant compressed in the compressor 110 may be introduced into the first connection tube 251 via the first flow switching device 122.

The refrigerant within the first connection tube 251 may be introduced into the eighth connection tube 158 through the third connection 175, and then, may be introduced into the first heat exchanger 130 through the second inlet/outlet 131*b*. The first heat exchanger 130 may be a load-side heat exchanger and may serve as the condenser.

The refrigerant condensed in the first heat exchanger 130 may be discharged into the fifth connection tube 155 through the third inlet/outlet 131*c*, and then, may be introduced into the third flow switching device 126. The third flow switching device 126 may guide the refrigerant into the seventh connection tube 157. The refrigerant within the seventh connection tube 157 may be decompressed while passing through the expansion device 160.

The refrigerant decompressed in the expansion device 160 may flow into the third connection tube 254 via the second flow switching device 124, and then, may be introduced into the second heat exchanger 140 through the first inlet/outlet 141*a*. The second heat exchanger 140 may be a heat source-side heat exchanger and may serve as the evaporator.

The refrigerant evaporated in the second heat exchanger 140 may be discharged into the ninth connection tube 159 through the second inlet/outlet 141*b*, and then, may be introduced into the fourth flow switching device 128. The fourth flow switching device 128 may guide the refrigerant into the compressor 110. This refrigerant cycle may be repeatedly performed.

According to the components and effects of the heat pump system according to embodiments disclosed herein, the shell and tube heat exchanger may be easily switched into the condenser or the evaporator according to the cooling or heating operation.

According to embodiments, as the system is improved in configuration so that the shell and tube heat exchanger may be used for all of the condenser and evaporator, that is, is switchable, the cooling and heating operations may be easily switched.

More particularly, as three inlet/outlets through which the refrigerant may be introduced or discharged, may be provided on the shell of the heat exchanger, and the inlet/outlet passages of the refrigerant may be changed according to the cooling or heating operation, the cooling and heating operations may be easily switched.

Also, a plurality of flow switching parts or devices to switch the flow of the refrigerant may be provided, and thus, flow direction of the refrigerant may be easily controlled according to the control of the plurality of flow switching parts.

Embodiments disclosed herein provide a heat pump system including a shell and tube heat exchanger in which cooling and heating operations may be easily switched.

Embodiments disclosed herein provide a heat pump system that may include a compressor that compresses a refrigerant; a condenser that condenses the refrigerant compressed in the compressor; an expansion device that decompresses the refrigerant condensed in the condenser; and an evaporator that evaporates the refrigerant decompressed in the expansion device. The condenser may include one heat exchanger of a first shell and tube heat exchanger and a second shell and tube heat exchanger. The evaporator may include the other heat exchanger of the first shell and tube heat exchanger and the second shell and tube heat exchanger. The first or second shell and tube heat exchanger may include a shell in which the refrigerant may be introduced; a plurality of tubes disposed within the shell and into which a fluid heat-exchanged with the refrigerant may flow; two inlet/outlet parts disposed on one side of the shell to guide introduction and discharge of the refrigerant; and one inlet/outlet part disposed on the other side of the shell to guide the introduction and discharge of the refrigerant. The first or second shell and tube heat exchanger may be switchable into the condenser or the evaporator according to a cooling or heating operation.

The heat pump system may further include a plurality of flow switching parts or devices to switch a flow direction of the refrigerant flowing into the first or second shell and tube heat exchanger. The plurality of flow switching parts may include a first flow switching part or device disposed on or at an outlet-side of the compressor; and a second flow switching part or device that guides the refrigerant decompressed in the expansion device into the evaporator.

The heat pump system may further include a third flow switching part or device that guides the refrigerant heat-exchanged in the condenser into the expansion device, and a fourth flow switching part or device that guides the refrigerant heat-exchanged in the evaporator into the compressor. Each of the plurality of flow switching parts may include a three-way valve.

The heat pump system may further include a first connection tube that extends from the first flow switching part to the first shell and tube heat exchanger, and a second connection tube that extends from the first flow switching part to the second shell and tube heat exchanger. The heat pump system may further include a third connection tube that extends from one point of the first connection tube to the second flow switching part, and a fourth connection tube that extends from one point of the second connection tube to the second flow switching part.

The heat pump system may further include a fifth connection tube that extends from the first shell and tube heat exchanger to the third flow switching part, and a sixth connection tube that extends from the second shell and tube heat exchanger to the third flow switching part. The heat pump system may further include a seventh connection tube on which the expansion device may be disposed. The seventh connection tube may extend from the second flow switching part to the third flow switching part.

The heat pump system may further include an eighth connection tube that extends from the first shell and tube heat exchanger to the fourth flow switching part, and a ninth connection tube that extends from the second shell and tube heat exchanger to the fourth flow switching part.

The two inlet/outlet parts may be disposed on an upper portion of the shell, and one inlet/outlet part may be disposed on a lower portion of the shell. The two inlet/outlet parts of the first shell and tube heat exchanger may include a first inlet/outlet part connected to the first connection tube, and a second inlet/outlet part connected to the eighth connection tube. The two inlet/outlet parts of the second shell and tube heat exchanger may include a first inlet/outlet part connected to the second connection tube, and a second inlet/outlet part connected to the ninth connection tube.

The heat pump system may further include an eighth connection tube that extends from the first shell and tube heat exchanger to the fourth flow switching part, and a first connection tube that extends from the second flow switching part to the eighth connection tube. The heat pump system may further include a ninth connection tube that extends from the second shell and tube heat exchanger to the fourth flow switching part, and a second connection tube that extends from the second flow switching part to the ninth connection tube.

The first shell and tube heat exchanger may be a load-side heat exchanger. The second shell and tube heat exchanger may be a heat source-side heat exchanger.

Although embodiments have been described with reference to a number of illustrative embodiments thereof, it should be understood that numerous other modifications and embodiments can be devised by those skilled in the art that will fall within the spirit and scope of the principles. More particularly, various variations and modifications are possible in the component parts and/or arrangements of the subject combination arrangement within the scope, the drawings, and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump system, comprising:

a compressor that compresses a refrigerant;

a condenser that condenses the refrigerant compressed in the compressor, wherein the condenser includes a first heat exchanger of a first shell and tube heat exchanger or a second shell and tube heat exchanger;

an expansion device that decompresses the refrigerant condensed in the condenser; and an evaporator that evaporates the refrigerant decompressed in the expansion device, wherein the evaporator includes a second heat exchanger of the first shell and tube heat exchanger or the second shell and tube heat exchanger;

a plurality of flow switching devices that switches a flow direction of the refrigerant flowing into the first shell and tube heat exchanger or the second shell and tube heat exchanger, wherein the plurality of flow switching devices includes a first flow switching device provided at an outlet-side of the compressor, a second flow switching device that guides the refrigerant decompressed in the expansion device into the evaporator, a third flow switching device that guides the refrigerant heat-exchanged in the condenser into the expansion device, and a fourth flow switching device that guides the refrigerant heat-exchanged in the evaporator into the compressor;

a first connection tube that extends from the first flow switching device to the first shell and tube heat exchanger;

a second connection tube that extends from the first flow switching device to the second shell and tube heat exchanger;

a third connection tube that extends from a point on the first connection tube to the second flow switching device; and a fourth connection tube that extends from a point on die second connection tube to the second flow switching device, wherein each of the first shell and tube heat exchanger and the second shell and tube heat exchanger is switchable into the condenser or the evaporator according to a cooling or heating operation, and wherein each of the first and second heat exchangers includes:

a shell into which the refrigerant is introduced;

a plurality of tubes provided within the shell and into which a fluid heat-exchanged with the refrigerant flows;

two inlet/outlets provided on a first side of the shell to guide the introduction or discharge of the refrigerant; and one inlet/outlet provided on a second side of the shell to guide the introduction or discharge of the refrigerant.

2. The heat pump system according to claim 1, wherein each of the plurality of flow switching devices includes a three-way valve.

3. The heat pump system according to claim 1, further including:

a fifth connection tube that extends from the first shell and tube heat exchanger to the third flow switching device; and a sixth connection tube that extends from the second shell and tube heat exchanger to the third flow switching device.

4. The heat pump system according to claim 3, further including a seventh connection tube on which the expansion device is provided, wherein the seventh connection tube extends from the second flow switching device to the third flow switching device.

5. The heat pump system according to claim 4, further including:

an eighth connection tube that extends from the first shell and tube heat exchanger to the fourth flow switching device; and a ninth connection tube that extends from the second shell and tube heat exchanger to the fourth flow switching device.

6. The heat pump system according to claim 5, wherein the two inlet/outlets are provided on an upper portion of the shell, and the one inlet/outlet is provided on a lower portion of the shell.

7. The heat pump system according to claim 5, wherein the two inlet/outlets of the first shell and tube heat exchanger includes:

a first inlet/outlet connected to the first connection tube; and a second inlet/outlet connected to the eighth connection tube.

8. The heat pump system according to claim 5, wherein the two inlet/outlets of the second shell and tube heat exchanger includes:

a first inlet/outlet connected to the second connection tube; and a second inlet/outlet connected to the ninth connection tube.

9. The heat pump system according to claim 1, wherein the first shell and tube heat exchanger is a load-side heat exchanger, and the second shell and tube heat exchanger is a heat source-side heat exchanger.

10. The heat pump system according to claim 1, wherein the two inlet/outlets are provided on an upper portion of the shell, and the one inlet/outlet is provided on a lower portion of the shell.

11. The heat pump system according to claim 1, wherein the expansion device includes an electronic expansion valve.

12. The heat pump system according to claim 1, wherein each of the first and second heat exchangers further includes an inflow passage connected to the plurality of tubes through which the fluid is introduced into the plurality of tubes and a discharge passage connected to the plurality of tubes through which the fluid heat-exchanged with the refrigerant is discharged.

13. The heat pump system according to claim 12, wherein the inflow passage and the discharge passage of each of the first and second heat exchangers are provided on a third side of the shell.

14. The heat pump system according to claim 13, wherein the fluid includes water.

15. The heat pump system according to claim 1, wherein each of the first and second heat exchangers further includes a distributor provided within the shell to distribute the refrigerant introduced into the shell.

16. The heat pump system according to claim 15, wherein the distributor of each of the first and second heat exchangers includes a plurality of through holes through which the refrigerant passes.

17. The heat pump system according to claim 15, wherein the distributor of each of the first and second heat exchangers is provided in an upper portion of the shell.

18. The heat pump according to claim 15, wherein the distributor of each of the first and second heat exchangers has a flat plate shape.

* * * * *